United States Patent [19]

Bilodeau et al.

[11] Patent Number: 4,565,012

[45] Date of Patent: Jan. 21, 1986

[54] MARKING AND MEASURING INSTRUMENT

[76] Inventors: Peter R. Bilodeau, 25 Fernbrook Rd., Northboro, Mass. 01532; Theodore W. Bilodeau, 535 Sudbury Rd., Concord, Mass. 01742

[21] Appl. No.: 638,033

[22] Filed: Aug. 6, 1984

[51] Int. Cl.[4] ..... B43L 7/06

[52] U.S. Cl. ..... 33/458; 33/529; 33/483

[58] Field of Search ..... 33/176, 175, 177, 174 N, 33/483, 458, 1 B, 429, 403, 529; 206/816; 160/84; 138/149; 229/37 R

[56] References Cited

U.S. PATENT DOCUMENTS

| | | | |
|---|---|---|---|
| 2,107,997 | 2/1938 | Horsley | 206/816 X |
| 2,559,961 | 7/1951 | Howell | 33/451 X |
| 3,557,840 | 1/1971 | Maybee | 138/149 |
| 3,974,946 | 8/1976 | Gentry | 33/176 X |
| 4,171,574 | 10/1979 | Gratzl et al. | 33/42 X |
| 4,219,149 | 8/1980 | Stark | 229/37 R |

FOREIGN PATENT DOCUMENTS

| | | | |
|---|---|---|---|
| 686700 | 3/1965 | Italy | 16/DIG. 13 |
| 6409593 | 2/1966 | Netherlands | 160/84 R |

*Primary Examiner*—Harry N. Haroian
*Attorney, Agent, or Firm*—M. E. Frederick

[57] ABSTRACT

A flexible marking and measuring instrument which can be folded or rolled as may be desired or convenient comprising a plurality of preferably elongated, rectangular, flat, thin members parallel one with another and sequentially flexibly connected one to another whereby the marking instrument may be folded or rolled to fit in a pocket or tool chest and/or bent or flexed to follow substantially any surface such as, for example, an elongated pipe, board, inside and outside corners, or surface of substantially any configuration. The parallel members may, inter alia, be of the same or different widths, the instrument may be provided with portions that are foldable at the same or different angles, the instrument may be provided with edges defining predetermined angles, the instrument may be provided with marking holes, and/or the instrument may be provided with such indicia as may be desired including but not limited to dimensions in English and/or metric units and lines designating angles.

12 Claims, 6 Drawing Figures

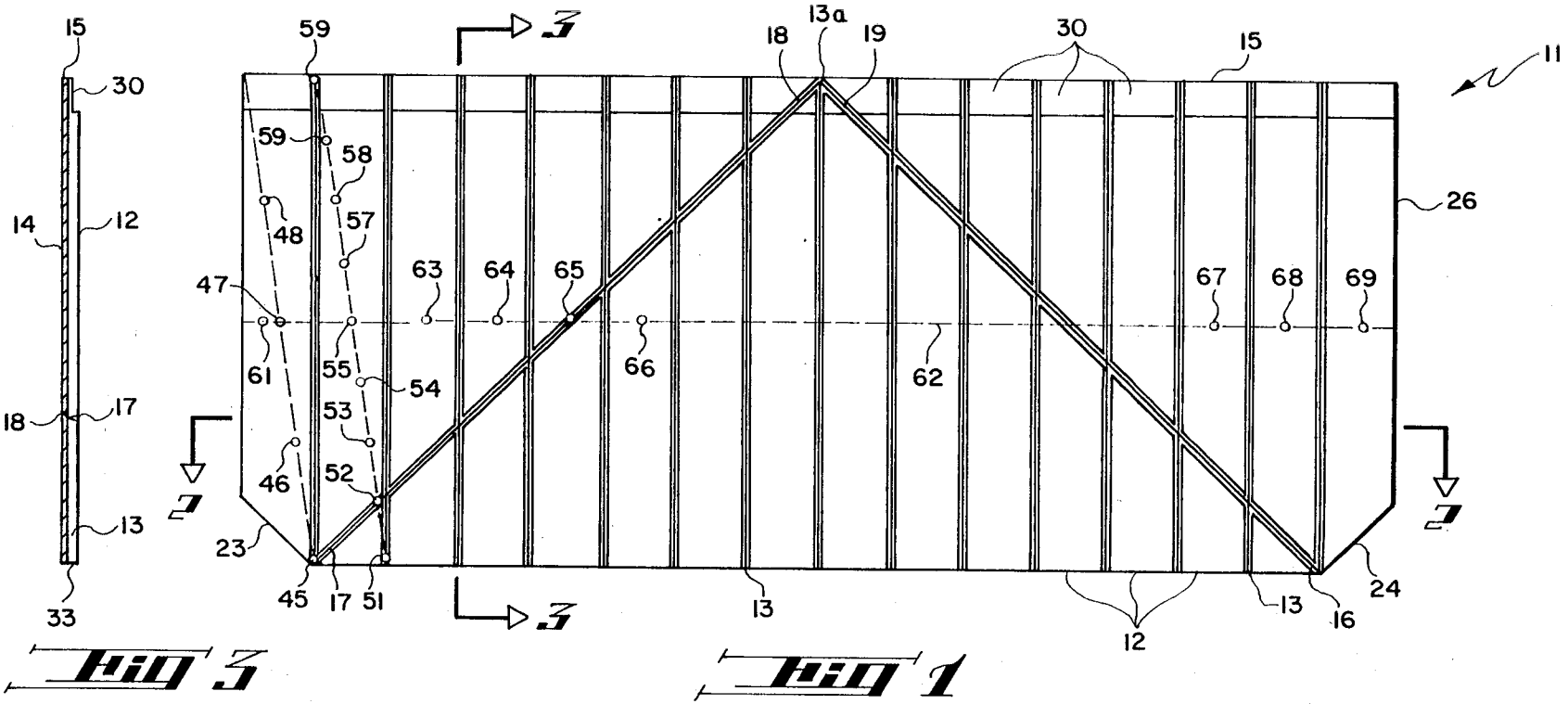
FIG. 1
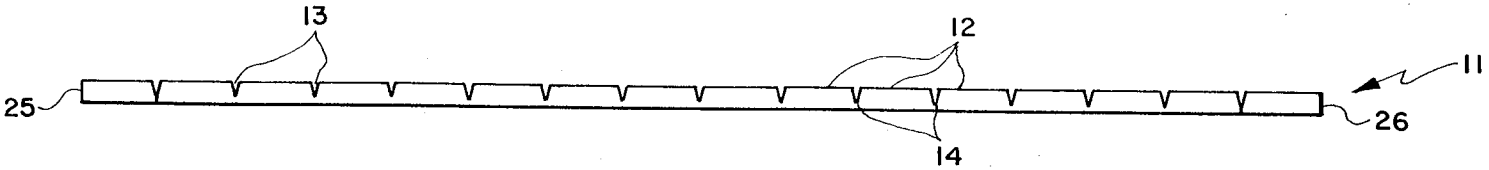
FIG. 2
FIG. 3

MARKING AND MEASURING INSTRUMENT

The present invention relates to marking and measuring instruments and more particularly to flexible marking and measuring instruments which are particularly adapted to aid carpenters, plumbers, electricians, metalworkers and the like in measuring, marking and laying out lines on all types and configurations of material.

Marking and measuring instruments in accordance with the present invention are flexible and may be folded or rolled up to fit in a worker's pocket or tool chest. They may be wrapped around cylindrical objects such as rods and pipes and the like to lay out continuous cylindrical lines concentric about or at an angle to the longitudinal axis of the rod or pipe, or to lay out lines on other surfaces at predetermined angles. They may be similarly used to lay out continuous lines on objects having irregular shapes such as, for example, window sills, curved or rectilinear projections, lay out continuous lines at inside and outside corners, or scribe a line off an edge of a board or curved surface. They may be opaque or transparent and carry indicia on their surfaces and they may be formed of a single sheet of material or a plurality of members.

The novel features and advantages of the present invention as well as additional features, advantages and objects thereof, will be more fully understood from the following description when read in connection with the accompanying drawings where:

FIG. 1 is a top view of one embodiment of a marking and measuring instrument in accordance with the invention;

FIG. 2 is a sectional side view taken on line 2—2 of FIG. 1;

FIG. 3 is a sectional end view taken on line 3—3 of FIG. 1;

Figure 4:
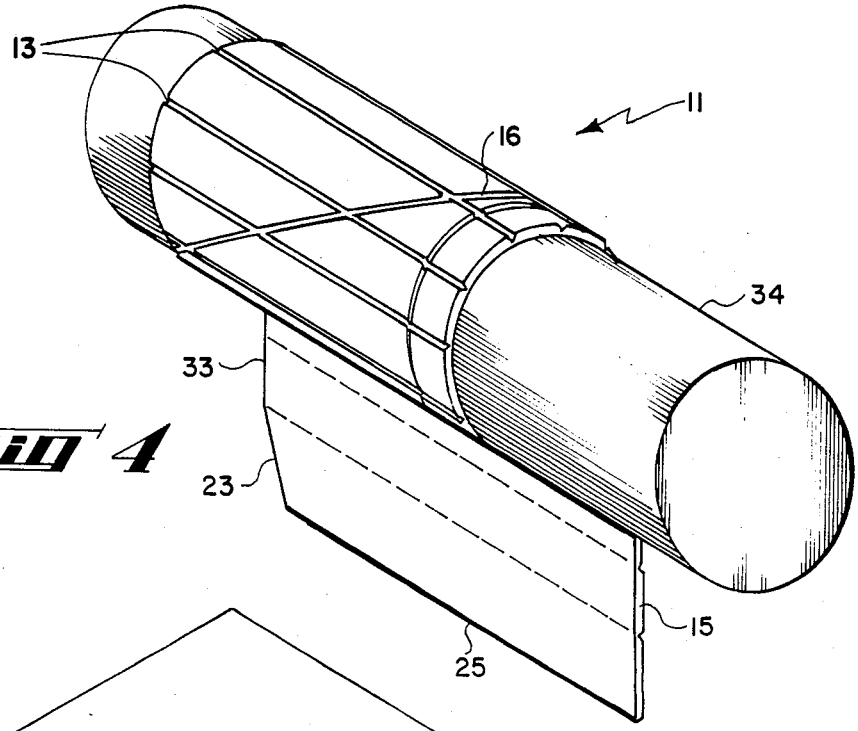
FIG. 4 illustrates the use of the marking and measuring instrument of FIG. 1 in marking a continuous line around a cylindrical member.

Directing attention now to FIGS. 1, 2 and 3, there is shown a flexible marking and measuring instrument indicated generally by the numeral 11 in accordance with the invention comprising a plurality of elongated, thin, rectangular, preferably rather stiff members 12 sequentially disposed one adjacent another and flexibly interconnected.

The term "flexible" is used herein in its broadest sense and designates the capability of being bent and/or flexed.

While it is to be understood that the elongate members 12 may be formed of a large number of different materials and flexibly interconnected in many different ways, for convenience and simplicity they will be described as being formed as by milling either generally U-shaped or vee-shaped grooves in a single piece of flexible plastic material having a high fatigue resistance such as, for example, Nylon, Celcon, Delrin, or the like. Thus, as shown by way of example in the drawings, each elongated member 12 may be easily and simply formed by milling straight vee-shaped grooves 13 at predetermined intervals along the length of the material to leave a thin and small, but highly durable hinge portion 14 between each elongated member 13. Such elongated members when so connected may be easily bent or flexed to 90° or more at the hinge portions 14 but when released may return to their original coplanar position. The hinge portions 14 may be about 0.020 inches thick. Alternately, for example, preformed separate elongated members having the same configuration as shown in FIGS. 1 and 2 may be bonded to a separate thin flexible backing material in generally closely spaced relationship one to another, the flexible backing having substantially the same thickness as the hinge portions 14. Alternately, while more difficult and more costly to accomplish, the hinge portions 14 may comprise a conventional two part hinge rotatable about a conventional hinge pin (not shown).

Inspection of FIG. 2, for example, will show that if the elongated members 12 are bent away from each other the width and depth of the vee-shaped grooves 13 shown by way of example and/or the thickness and spacing of the elongated members 12 is not critical. However, these dimensions are important in the event it is desired to bend or flex the elongated members 12 toward one another. Accordingly, these dimensions in accordance with the invention are selected to provide the desired degree of flexing or bending in this latter direction. This can be of importance, for example, when it is desired to use the marking and measuring instrument to lay out a continuous line on an inside corner. Alternately, the bight of grooves 13 may be made flat and wider, which is to say the hinge portions 14 are made wider and more or less rectangular in cross section.

While the elongated members 12 may be preferably formed of a suitable material (which can be either opaque or transparent as desired) that has at least some degree of stiffness as and for such purposes as will hereinafter be pointed out, they should be relatively thin such as, for example, about 0.070 to about 0.090 inches thick. Further the elongated members 12 may all be of the same effective width or the effective width dimension of different ones or all of them may be varied such as, for example, to be the same dimension (the center of one hinge portion to the center of the next succeeding hinge portion) as that of different thicknesses of boards and the like as and for such purpose as will be more fully discussed hereinafter. Additionally, while less versatile than that shown in FIGS. 1–3, it will be appreciated that the elongated members need not necessarily be flat and that the number of elongated members may be reduced to a minimum of two coupled by a single hinge member in combination with grooves disposed at an angle such as, for example, grooves 18 and 19.

Figure 5:
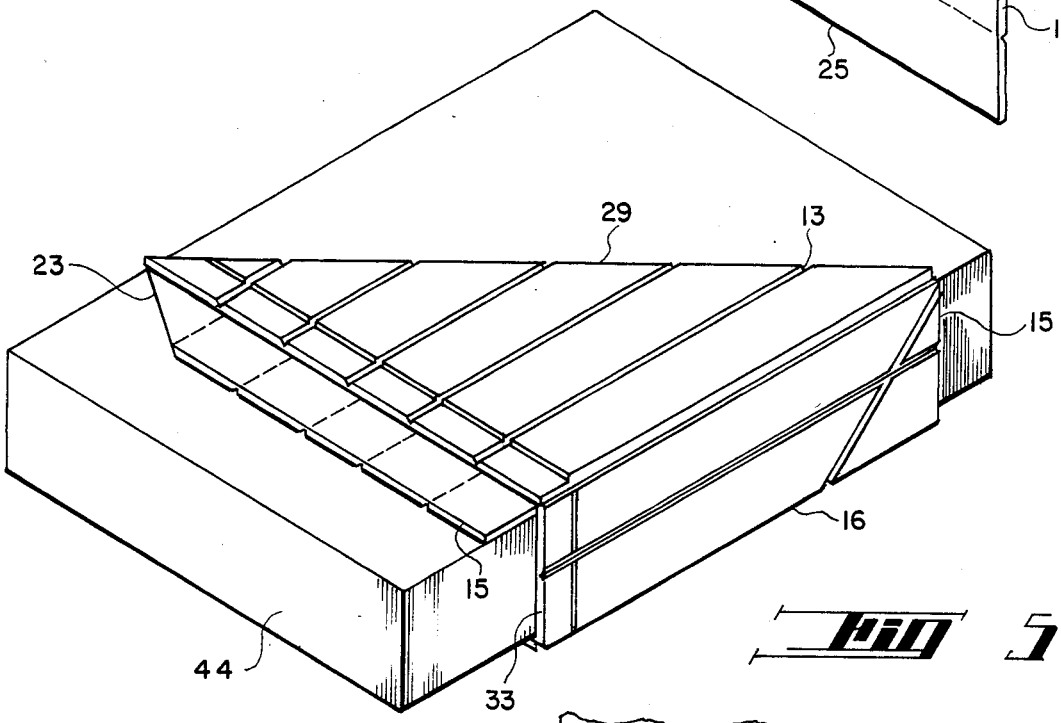
FIG. 5 illustrates the use of the marking and measuring instrument of FIG. 1 in marking straight lines and lines at predetermined angles such as 45° and 90°.

In order to permit lines to be laid out at predetermined angles with respect to a given reference such as edge 15 (see FIG. 5), vee-shaped grooves 16 and 17 similar to grooves 13 and defining hinge portions 18 and 19 at a predetermined angle to edge 15 may be provided. Thus groove 16 and groove 17 may both be disposed at an angle of 45° to edge 15 and meet at the end of groove 13*a* at edge 15. Further, if the outside corners of the outermost elongated members are cut off to define edges 23 and 24 at, for example, 45° to respectively edges 25 and 26 and 90° with respect to grooves 16 and 17, further multipurpose marking edges are provided. For example, if the left hand portion 27 is folded under as shown in FIG. 5, edge 23 forms an angle of 90° with groove 17 which now defines a marking edge 29 disposed at an angle of 45°. Further, if the instrument is bent over the edge of a board or the like along groove 18, for example, so that groove 18 is coincident with the edge of the board, edges 25 and 33 will each be disposed for laying out a line at 45° to the edge of the board (in either direction depending on which portion of the instrument is on the top surface of the board) and edge 23 will be disposed for laying out a line at 90° to the edge.

It is to be further noted that the provision of grooves such as grooves 13, 16 and 17, in addition to providing the ability to follow almost exactly surfaces at angles of 90° or more to each other, permit the marking of lines at selected precise distances from precise angles to (parallel, at 45°, etc.) such an edge when the instrument is bent around such an edge at a groove.

It is to be understood that a greater or lesser number of grooves than angularly disposed grooves 16 and 17 may be provided, they may be at different locations and/or they may be disposed at different angles as may be desired. Further, whereas a generally rectangular device has been illustrated in FIG. 1, it need not be rectangular in form and may be provided with an irregular configuration, additonal different sides being at different angles and/or at different angles one with another. Thus, edges 15 and 26 may be foreshortened and interconnected to define an edge at 45° to now foreshortened edges 15 and 26 and edges 25 and 33 may be similarly foreshortened and interconnected to define an edge at an outside angle of 60° with edge 25 and an outside angle of 30° with edge 33. In the event it is desired to use, for example, edge 15 as a ruler and provide inch and/or metric indicia therealong, the end portions of members 12 adjacent edge 15 may be stepped to provide a recessed lip on surface 30 to receive the indicia. Being provided on a recessed surface, the indicia will be as close as possible to the work surface and will be protected.

Directing attention now to FIG. 4, this figure illustrates the use of the invention for scribing a continuous line around a cylindrical member 34 and lying in the same plane. Utilization of, for example, edge 23 permits a line at 45° to be scribed. Further, if the instrument is bent along groove 18 such that groove 18 is parallel with the longitudinal axis of a pipe or the like and the portions of the instrument adjacent groove 18 placed in contact with the pipe, edge 33 will be disposed at 45° to the longitudinal axis of the pipe.

Figure 6:
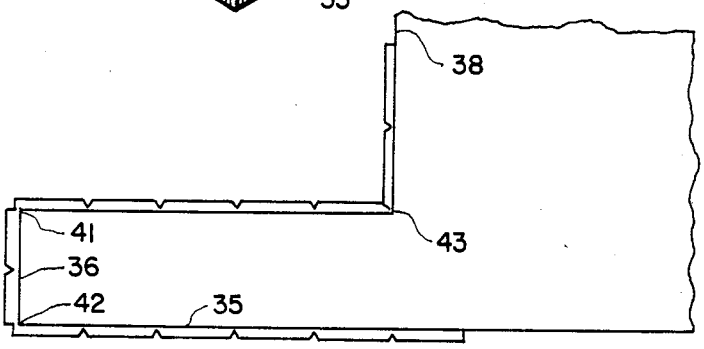
FIG. 6 illustrates the use of the marking and measuring instrument of FIG. 1 in marking a continuous line on four surfaces including two outside corners and one inside corner.

FIG. 6 illustrates the use of the invention in scribing a continuous line on four surfaces 35–38 including two outside corners 41 and 42 and one inside corner 43 and FIG. 5 illustrates the scribing of continuous lines on different sides of a board 44, and lines at predetermined angles to the edge of a board and/or another line such as, for example, lines along edges 23 and 29.

Marking and measuring instruments in accordance with the invention are particularly useful in locating, for example, oppositely disposed points on opposite sides of a door and points on the outside edge of the door (see FIGS. 5 and 6) at precisely the same height as the oppositely disposed points. Where one or more elongated members are the same width as the thickness of the door as illustrated in FIGS. 5 and 6, the marking instrument will fit very closely. It is to be noted that even if the elongated members are highly flexible in their length or greatest dimension, when the marking instrument is bent or flexed at a given hinge portion to conform to an edge of a board or the like as shown in FIG. 5, this functions as an accurate guide and other edges and marking points as may be provided are thereby fixedly and accurately located and can be simply, quickly and precisely repeatedly relocated. The provision of suitable pencil tip holes in one or more of the elongated members as shown in FIG. 1 permits accurate and repeatable scribing of a line from an edge of a board or the like. Thus, four equally spaced pencil tip holes 45–48 may be provided along a diagonal 49 as shown in FIG. 1 on the outermost left hand elongated member and having by way of example a width of one-half inch. In this case, starting with the lowermost pencil tip hole 45, each succeeding hole 46–48 will be precisely one-eighth inch closer to the outermost left hand edge 25. If now the number of elongated members 12 are bent over the edge of a board or the like such that the distance it is desired to scribe off from the edge to one-eighth of an inch is within one-half inch of the desired distance, such distance may be easily, quickly and repeatedly scribed by inserting a pencil tip in the proper hole 45–48 and sliding the marking instrument 11 along the board. Similarly, as shown in the second elongated member, additional holes 51–59 can be provided to permit variations of one sixteenth of an inch. Other variations as may be desired may be similarly provided in the same or different elongated members. The location of pencil tip holes along a diagonal or the like as shown in FIG. 1 permits substantially any variation in distance desired without substantially weakening the elongated member or members in which they are provided.

The marking instrument may also be used to scribe circles having a diameter substantially equal to the length of the instrument. Thus, a pivot hole 61 may be provided in the extreme left hand elongated member, for example, on line 62 and pencil holes 63–69 having a predetermined spacing one with another also may be provided along line 62 to the opposite end of the instrument. If now the instrument is pivoted about pivot hole 61 with a pencil tip inserted in a hole along line 62 at the desired distance from the pivot hole 61, a circle may be easily, accurately and repeatedly scribed. While the invention has been shown and described as having open grooves it is to be understood that if desired these grooves may be filled with a compressible and elastic material if, for example, a smooth surface is desired and/or it is desired that means be provided to insure return of the instrument to a planar condition after it has been bent around a corner or the like.

While the preferred embodiments of the invention have been illustrated and described, it will be understood by those skilled in the art that changes and modifications may be resorted to without departing from the spirit and scope of the invention and the invention is therefore to be limited only as indicated by the scope of the appended claims.

What is claimed is:

1. A line marking instrument for marking off lines and distances comprising:

(a) a series of elongated portions each having a width dimension, length dimension and thickness dimension sequentially disposed in side by side relationship with respect to their length dimensions, said width dimension being substantially less than said length dimension and said thickness dimension being less than said width dimension, each said elongated portion having at its extreme ends oppositely disposed first and second end portions, each terminating in a line marking edge;

(b) first hinge means interconnecting adjacent portions at their length dimension whereby said portions are pivotally interconnected, said first hinge means defining first straight grooves between and extending the length of adjacent elongated portions, all of said first end portions being serially disposed one to another and all of said second end portions being serially disposed one to another, the line marking edges of said first end portions substantially defining a first straight elongated line marking edge and the line marking edges of said second end portions substantially defining a second straight elongated line marking edge; and (c) at least one second hinge means defining a second straight elongated groove disposed at an angle to and passing through predetermined consecutive ones of said first grooves.

2. A marking instrument as defined in claim 1 wherein said portions are separate members and said means interconnecting said portions is at least one thin flexible member attached to said portions whereby said members are flexibly interconnected.

3. A marking instrument as defined in claim 1 wherein said portions are at least substantially flat and are formed of plastic having a predetermined thickness and said means flexibly interconnecting said portions is integral with and formed of the same material as said portions and has a thickness less than that of said portions.

4. A marking instrument as defined in claim 2 wherein the sides of each said portion along its length dimension are sloped toward each other.

5. A marking instrument as defined in claim 3 wherein said grooves each have an at least substantially vee-shaped cross section.

6. A marking instrument as defined in claim 3 wherein said grooves each have an at least substantially U-shaped cross section.

7. A line marking instrument as defined in claim 1 wherein said portions define an outer periphery of said instrument comprising a plurality of line marking edges, certain line marking edges being disposed at ninety degrees with respect to each other and at least one other line marking edge being disposed at other than ninety degrees with respect to at least one of said certain line marking edges.

8. A marking instrument as defined in claim 1 wherein said portions are at least substantially flat and at least one of said portions has a plurality of holes disposed sequentially along its length dimension, said holes each being sequentially spaced a different distance from a hinge means associated with said flat portion.

9. A marking instrument as defined in claim 1 wherein predetermined ones of said portions have different width dimensions.

10. A line marking instrument for marking off lines comprising:

(a) a flat sheet of flexible material having peripheral line marking outer edges at predetermined angles one with another, said sheet having a series of sequential first grooves parallel one with another, each spaced a predetermined distance from the next adjacent groove, said first grooves extending entirely across said sheet and having dimensions whereby each first groove defines a thin hinge portion of said sheet below each said groove whereby said sheet may be easily and repeatedly bent at said grooves, adjacent first grooves each defining an elongated portion having a width dimension, a length dimension in the direction of said first grooves, and a thickness dimension, said width dimension being substantially less than said length dimension and said thickness dimension being less than said width dimension, each said elongated portion having at its extreme ends oppositely disposed first and second end portions each terminating in a line marking edge, the line marking edges of said first end portions substantially defining one of said line marking edges and the line marking edges of said second end portions substantially defining another of said line marking edges, adjacent first grooves defining substantially rectangular portions and said sheet having at least one further groove defining further hinge means disposed at an angle to and passing through predetermined consecutive ones of said first grooves.

11. A marking instrument as defined in claim 1 wherein said first grooves have side portions sloping away from each other and at least one of said flat portions has a plurality of first pencil tip holes disposed sequentially along a diagonal line extending in its length direction, said holes being each sequentially spaced a different distance from a first groove defining one side of said flat portion.

12. A marking instrument as defined in claim 11 wherein said sheet has a plurality of second pencil tip holes disposed a predetermined distance apart and extending in a direction perpendicular to said first grooves.

* * * * *